United States Patent [19]

Ovitz, III

[11] Patent Number: 4,757,906

[45] Date of Patent: Jul. 19, 1988

[54] DISPLAY RACK FOR FLOORING SAMPLES

[75] Inventor: Ernest G. Ovitz, III, Galva, Ill.

[73] Assignee: John H. Best & Sons, Galva, Ill.

[21] Appl. No.: 79,954

[22] Filed: Jul. 31, 1987

[51] Int. Cl.[4] ..... A47F 7/16

[52] U.S. Cl. ..... 211/45; 211/89; 211/120

[58] Field of Search ..... 211/45, 181, 11, 50, 211/89, 69.8, 120

[56] References Cited

U.S. PATENT DOCUMENTS 1,757,981 5/1930 Stephenson ..... 211/89

2,507,886 5/1950 Carlson ..... 211/89

3,908,215 9/1975 Watson ..... 211/11 X 4,682,697 7/1987 Cohen ..... 211/45

*Primary Examiner*—Ramon S. Britts

*Assistant Examiner*—Sarah A. Lechok Eley

*Attorney, Agent, or Firm*—Kinzer, Plyer, Dorn, McEachran & Jambor

[57] ABSTRACT

A rack for displaying samples of flooring constructed of heavy gauge wires to present upright members, dividers secured to the uprights one above another in parallel spaced relation, side supports in vertical planes between the dividers and defining therewith slots into which can be slipped the upper and lower spans of a rectangular sample folded into U-shape.

2 Claims, 2 Drawing Sheets

DISPLAY RACK FOR FLOORING SAMPLES

This invention relates to a display rack for exhibiting flooring samples, especially vinyl flooring.

BACKGROUND AND OBJECTIVES OF THE INVENTION

Traditional display means for vinyl flooring samples have generally been of several types. There is a display device in which the samples are hung on rectangular frames which are swingable like hinged doors in a row or the pages of a book held upright. Another display device is one where the samples are displayed on a stand in a cascading array, like a water slide at an amusement park, so that it is necessary to lift one sample to see another, even though the samples beneath the top one have exposed ends like a sloped deck of cards.

There is yet another arrangement for displaying floor covering samples in which the samples are arranged one above another in a rack like a row of books turned on their sides but it is still necessary for the customer to withdraw a sample for a complete view of the design, especially those at the higher levels of the rack.

Yet another arrangement is one in which the samples are rolled up or folded like towels stacked on closet shelves The samples are heavy and the construction is expensive. In these same racks, there may also be "bound" samples in the form of sample books themselves, that is, many samples captured in a backbone clamp, like leafing through the pages of a book.

OBJECTIVES AND GENERAL CONSTRUCTION OF THE PRESENT INVENTION

The primary object of the present invention is to construct a display rack for floor covering samples, especially vinyl flooring, in an inexpensive manner and yet in such a fashion that the samples may be readily seen, all at once, and a related object to the present invention is to so construct the display rack that it is nonetheless strong and sturdy.

In general, the construction under the present invention is a flooring sample display rack in which the principal supporting elements are wire (rod) members, bent to shape, rigidly supported and so spaced and arranged as to enable a substantially rectangular sample of the flooring material to be folded into U-shape and inserted into receiving slots presented by the display rack.

Description of the Preferred Embodiment

Figure 1:
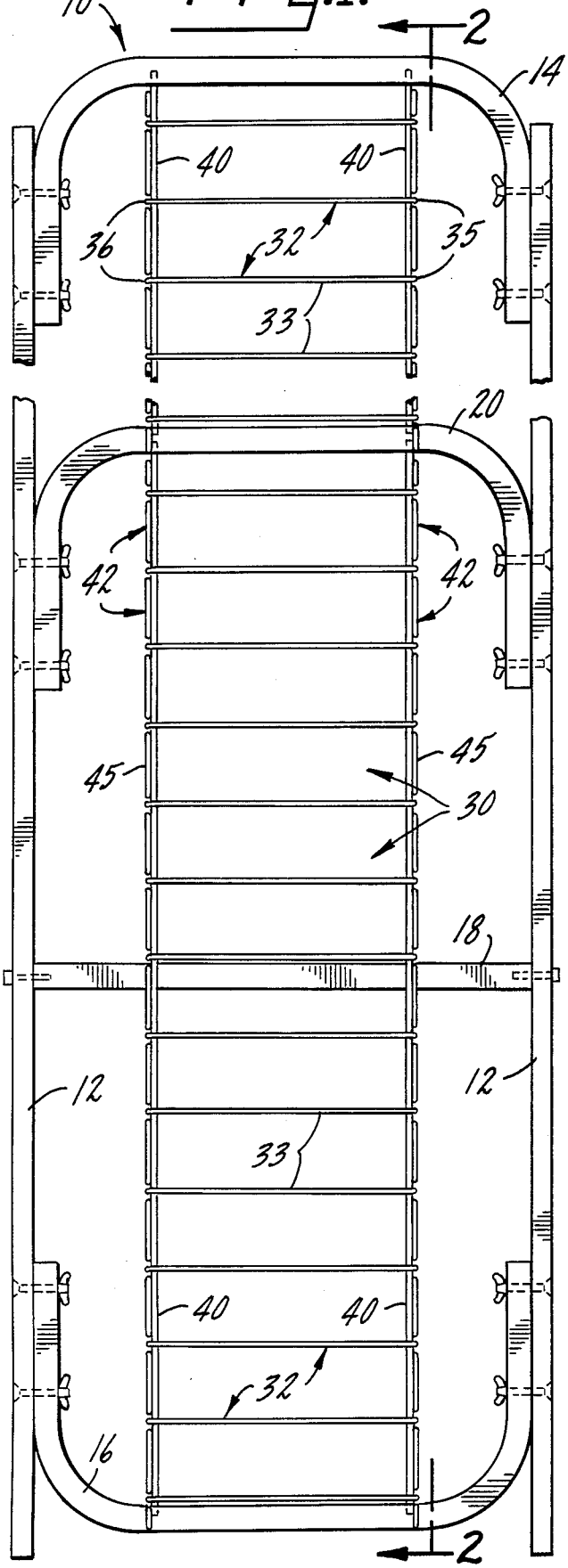
FIG. 1 is a front elevation of a display rack consturcted in accordance with the present invention, partly fragmented.
Figure 2:
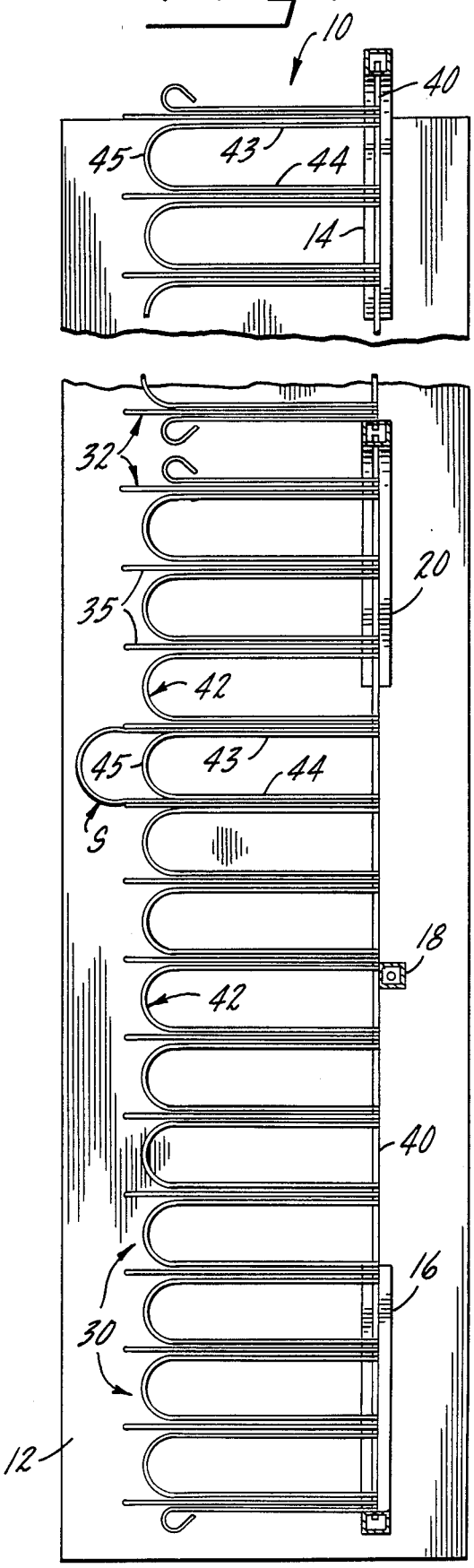
FIG. 2 is a sectional view substantially on the line 2—2 of FIG. 1.

The display rack of the present invention 10, FIGS. 1 and 2, comprises a pair of upright laterally spaced vertical side panels 12, preferably of wood construction. These panels are spaced and rigidly joined by a strong, substantially U-shaped metal tube member 14 at the head or top, a like foot member 16 and horizontal spacers as 18 where needed Suitable fasteners are employed for securing these members to the panels, as shown in the drawing. An intermediate additional brace of U-shaped form 20 may also be employed where necessary, joined at the opposite ends to the inside faces of the side panels 12 like members 14, 16 and 18.

The basic supporting backbone or skeleton structure of the rack 10 as thus specified is self-standing and adequate to carry the weight of the samples to be described hereinafter. The top of the rack may be finished with a suitable headboard to suit the customer.

Under and in accordance with the present invention the display rack comprises a series of vertical receiver units 30 or pigeon holes which are of heaavy gauge wire (rod) form. The receivers are so constructed and arranged as to present receiving slots in which may be inserted the upper and lower legs of a sample folded into U-shape. Such a sample is identified by reference character S in FIG. 3.

Thus, in accordance with the present invention a plurality of vertically spaced receiver units 30 are arranged between the supporting side panels 12. The receiver units comprise a plurality of vertically spaced, substantially U-shaped wire dividers 32, FIGS. 1 and 2, each such divider as 32 comprising a front horizontal leg 33, FIG. 1, and a pair of laterally spaced, rearwardly extending horizontal leg elements 35 and 36, FIG. 3. The legs lie substantially in one plane. It will be seen that the dividers thus constructed are substantially U-shaped and disposed in horizontal planes, one spaced above the other.

The rear ends of the side legs 35 and 36 of each divider are welded or otherwise rigidly attached to a corresponding pair of laterally spaced upright support heavy gauge wire (rod) members 40.

The receivers 30 additionally comprise a pair of laterally spaced U-shaped heavy gauge wire (rod) side supports 42 FIG. 2. These side supports comprise a pair of laterally spaced upper and lower legs 43 and 44, together with a forwardmost arcuate bend 45, FIG. 2. Again, the aft ends of the laterally spaced U-shaped supports 42 are welded or otherwise rigidly attached to the upright rod members 40.

Figure 3:
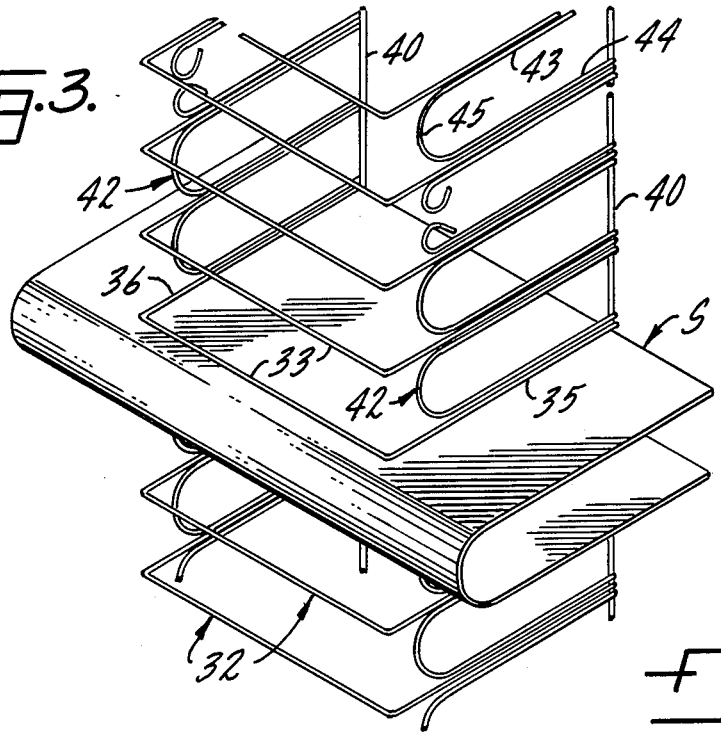
FIG. 3 is a partial perspective view of a fragment of the present rack showing the display method.

As will be particularly evident in FIGS. 2 and 3, the upper and lower legs of the U-shaped lateral side supports are closely spaced from (and in a-ignmen1t with) the corresponding legs of the dividers, thereby defining narrow slots into which can be slid the upper and lower spans of the folded samples as S.

Figure 4:
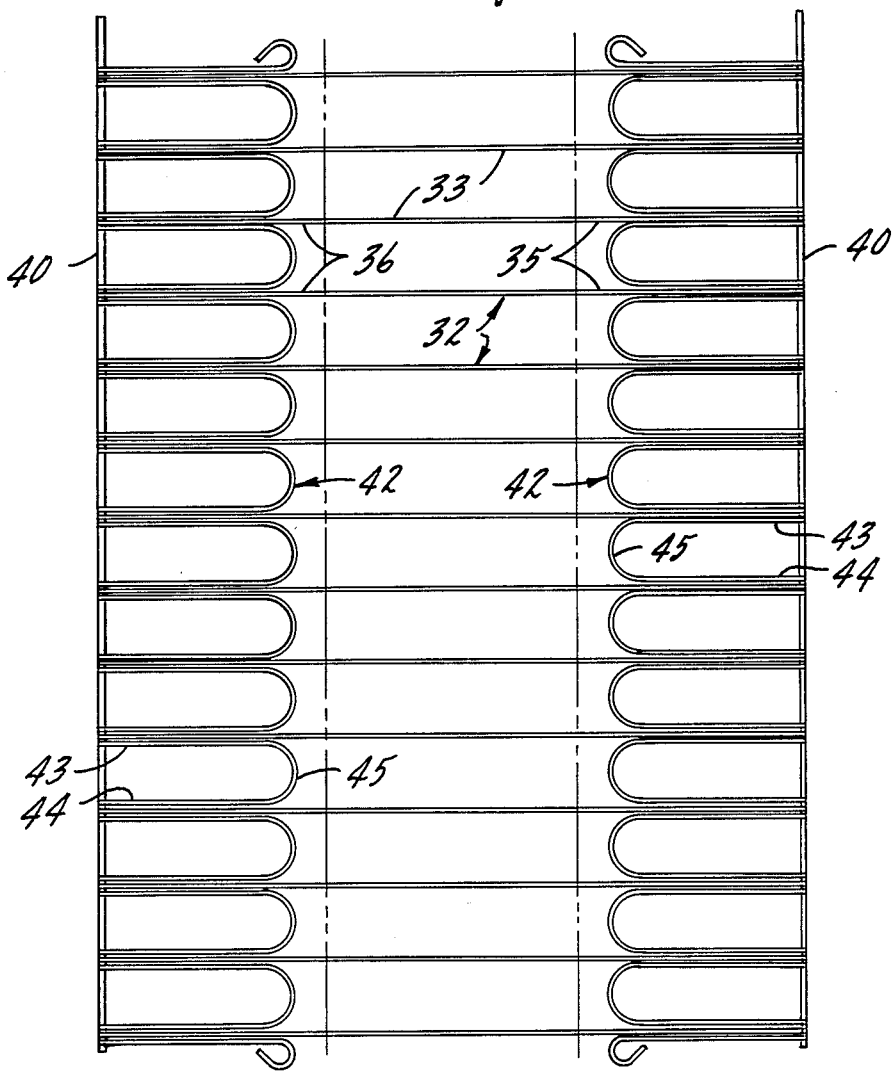
FIG. 4, is a plan view showing the manner in which the elements forming the receivers may be easily assembled and erected.

The receiver construction may be readily fabricated, FIG. 4. The upright support rods 40 are accurately spaced on the floor. The ends of the wires or rods to constitute the dividers 32 are then secured in parallel spaced relation to the spaced rods 40, like rungs on a ladder, whereafter the U-shaped wirelike or rodlike side supports 42 are then arranged in two uniform rows between the dividers as shown in FIG. 4. The rows of supports 42 are equidistantly spaced from two center lines as shown in FIG. 4. This assembly can be completed on the floor, in a horizontal plane, and afterwards the assembly may be bent along the center lines indicated in FIG. 4 to complete the divider configuration The uprights 40 may have their upper and lower ends anchored in or on the header 14 and the foot 16. They may be welded to the cross bracer as 18. However, depending upon the height, there may be two receiver units constructed in the fashion shown in FIG. 4 in which event they are arranged end-to-end with their upper and lower ends respectively secured in or to a bracer as 20.

It will be seen from the foregoing that under the present invention I am able to construct an inexpensive but nonetheless sturdy and dependable rack for floor covering samples. The essential construction resides in the employment of heavy duty wire members, or equivalent rods of reduced diameter, easily bent, to respectively afford the spaced U-shaped dividers and the laterally spaced U-shaped supports so arranged with respect to one another as shown in FIG. 3 as to define a pair of vertically spaced slots capable of receiving the folded sample S. The sample, if removed, readily flexes into a flat position as a natural phenomenon of having the design side facing outward, as it would be in FIG. 3, for ready comparison and observation by the interested customer.

I claim:

1. A display rack for floor covering samples comprising (A) a series of vertical receivers each defined by:

a pair of substantially U-shaped wirelike dividers each lying in a horizontal plane ,and having laterally spaced legs with the free ends thereof secured to upright supporting members;

a pair of laterally spaced U-shaped wirelike side supports each lying in a vertical plane between a pair of dividers and having upper and lower legs in opposed, closely spaced relation to the legs of the dividers to define therewith vertically spaced receiving slots into which can be slipped a rectangular sample folded into U-shape; and (B) a floor-mounted framework supporting said receivers.

2. A rack according to claim 1 in which the receivers are constructed by arranging the upright members parallel to one another in a horizontal plane; fastening in uniform parallel, spaced relation to the upright members the opposite ends of a plurality of wires which are to become the dividers; arranging the U-shaped wirelike side supports between the divider wires and fastening their ends to the support members, thereby making two rows of supports, which rows are separated by intermediate lengths of the wires which are to become the dividers, thereby completing an assembly; and then bending the assembly along two parallel center lines which are respectively equidistant inward of the upright members to render U-shaped the wires which are to be the dividers.

* * * * *